United States Patent [19]

Theurer et al.

[11] Patent Number: 4,614,238

[45] Date of Patent: Sep. 30, 1986

[54] ARRANGEMENT FOR EXCAVATING BULK MATERIAL FROM A TRACK BED

[75] Inventors: Josef Theurer, Vienna; Manfred Brunninger, Linz, both of Austria

[73] Assignee: Franz Plasser Bahnbaumaschinen-Industriegesellschaft m.b.H., Vienna, Austria

[21] Appl. No.: 566,280

[22] Filed: Dec. 28, 1983

[30] Foreign Application Priority Data

Jan. 10, 1983 [AT] Austria ..... 69/83

[51] Int. Cl.[4] ..... E01B 27/06; B65G 19/00

[52] U.S. Cl. ..... 171/16; 104/2; 198/520

[58] Field of Search ..... 171/16; 104/2, 7 R, 104/7 B; 198/852, 851, 520, 516

[56] References Cited

U.S. PATENT DOCUMENTS

| | | | |
|---|---|---|---|
| 2,071,485 | 2/1937 | Worrall | 198/852 |
| 2,101,238 | 12/1937 | Cartlidge | 198/520 |
| 2,649,812 | 8/1953 | Wylie | 198/852 |
| 2,753,982 | 7/1956 | Fredrickson | 198/852 |
| 2,899,759 | 8/1959 | Campbell | 171/16 X |
| 3,107,777 | 2/1959 | Steorts, Jr. | 198/852 |
| 3,685,589 | 8/1972 | Plasser et al. | 171/16 |
| 3,850,251 | 11/1974 | Plasser et al. | 171/16 |
| 4,014,389 | 3/1977 | Theurer et al. | 171/16 |
| 4,043,398 | 8/1977 | Fölser et al. | 171/16 |
| 4,071,054 | 1/1978 | Santucci et al. | 198/852 X |
| 4,152,989 | 5/1979 | Theurer et al. | 104/2 |
| 4,186,804 | 2/1980 | Theurer et al. | 104/7 R |
| 4,418,817 | 12/1983 | Martin et al. | 198/851 X |
| 4,432,284 | 2/1984 | Theurer et al. | 104/7 R |
| 4,538,687 | 9/1985 | Theurer et al. | 171/16 |

FOREIGN PATENT DOCUMENTS 2550391 8/1977 Fed. Rep. of Germany .

OTHER PUBLICATIONS

Plasser & Theurer Sales Literature, "RM 76 UHR/Ballast Cleaning Machine" (Part No. S 12/E 728), Austria, undated.

*Primary Examiner*—Richard T. Stouffer
*Assistant Examiner*—Terrence L. B. Brown
*Attorney, Agent, or Firm*—Kurt Kelman

[57] ABSTRACT

An arrangement for excavating bulk material from a track bed and for conveying the excavated bulk material, which comprises an endless driven excavating and conveying chain vertically adjustably mounted on a frame of a track working machine, and a guide wherein the chain is guided in an endless path. The chain is comprised of a succession of chain links and joints connecting adjacent chain links, the joints having two pivoting axles for the adjacent chain links, the axles extending perpendicularly to each other to permit pivoting of the chain links. The guide includes two longitudinal guide sections, an excavated bulk material discharge station at adjacent upper longitudinal guide section ends, and a transverse guide section connecting the lower longitudinal guide section ends opposite to the discharge station, the longitudinal guide sections forming transition portions at the lower ends for connection to the transverse guide section, the transition portions being bent in a direction extending substantially parallel to the plane of the track bed. Guide elements for the chain links guide the chain longitudinally along the transition portions. A chain guide roller in each transition portion deflects the chain from a respective longitudinal guide section to the transverse guide section.

9 Claims, 11 Drawing Figures

ARRANGEMENT FOR EXCAVATING BULK MATERIAL FROM A TRACK BED

Figure 1:
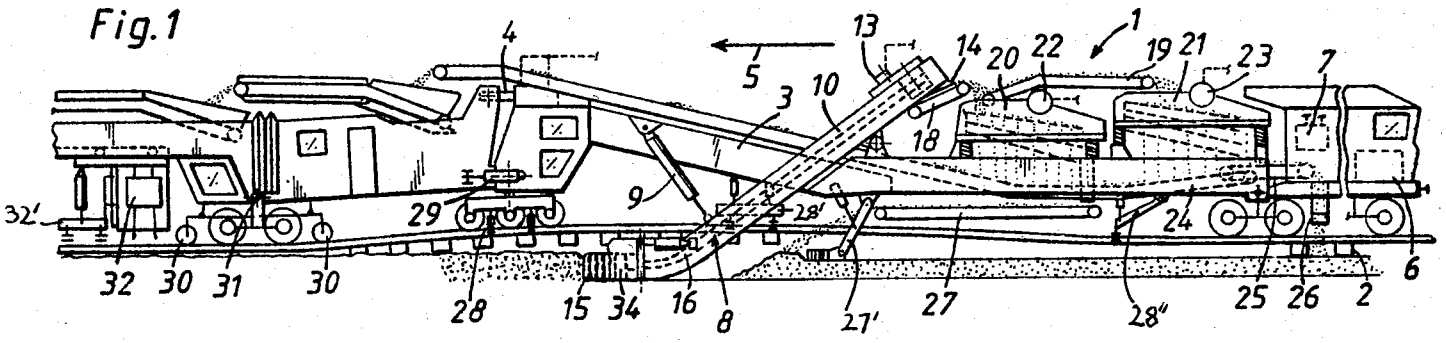

The present invention relates to an arrangement for excavating bulk material from a track bed and for conveying the excavated bulk material. The arrangement comprises an endless excavating and conveying chain vertically adjustably mounted on a frame of a track work machine, such as a ballast cleaning machine, and a guide wherein the chain is guided in an endless path. The guide includes two longitudinal guide sections, each longitudinal guide section having an upper end and a lower end, the upper ends being adjacent each other, an excavated bulk material discharge station at the adjacent upper ends of the longitudinal guide sections, and a transverse guide section connecting the lower longitudinal guide section ends opposite to the discharge station, the longitudinal guide sections each having a major portion obliquely rising from the track bed and a transition portion at the lower end for connection to the transverse guide section, the transition portions extending substantially parallel to the the track bed. Chain drive means is positioned at the adjacent upper longitudinal guide section ends. A chain guide roller deflects the chain from a respective longitudinal guide section to the transverse guide section in each transition portion.

A ballast cleaning machine showing an arrangement of this general type has been disclosed, for example, in U.S. Pat. No. 4,014,389, dated Mar. 29, 1977. The chain is comprised of a succession of chain links pivotally connected to each other. To adapt the machine to work in track switches, the transverse chain guide section may be lengthened and the length of the chain may be correspondingly increased by adding chain links of the required length thereto. This machine has been very successfully used, particularly where ballast cleaning of beds of varying widths is required.

U.S. Pat. No. 4,152,989, dated May 8, 1979, discloses a track renewal train incorporating an elongated bridge-like carrier for a ballast excavating and planing chain arrangement working on a track section from which the old track has been removed. In one of the disclosed embodiments, the chain guide comprises two almost parallel longitudinal guide sections and upper and lower transverse guide sections respectively connecting the upper and lower ends of the longitudinal guide sections for guiding the chain in a substantially rectangular path. Two drives at the upper longitudinal guide section ends drive the chain. The excavated ballast is discharged at two stations along the upper transverse guide sections into two chutes for redistribution into cribs between newly laid ties. This arrangement has been successfully used in track renewal trains for planing the track bed.

U.S. Pat. No. 3,850,251, dated Nov. 26, 1974, discloses a mobile ballast cleaning machine with an arrangement of the first-indicated type wherein the transition portions of the longitudinal guide sections extend parallel to the track bed plane. This arrangement also was designed to work in track switches but some technical difficulties in the particular construction have discouraged commercialization of the machine described in this patent.

Published German patent application No. 2,550,391, published Aug. 18, 1977, discloses a ballast cleaning machine with a ballast excavating chain arrangement but nothing at all is disclosed about the specific structure of the chain or the connection between the chain links.

It is the primary object of this invention to provide an arrangement of the first-described type but which has an enhanced operating capacity.

The above and other objects are accomplished according to the invention with a chain comprised of a succession of chain links in the direction of elongation of the chain and joints connecting adjacent ones of the chain links, the joints having pivoting axles for the adjacent chain links, the axles extending perpendicularly with respect to each other to permit pivoting of the chain links in mutually perpendicular planes. The chain links have guide elements for guiding the chain longitudinally, particularly along the transition portions.

In such a bulk material excavating and conveying arrangement, a firm guidance and deflection of the chain is assured, particularly along the bent transition portions, while avoiding the friction and deflection forces to which the chain is subjected in these portions, and this guidance and deflection will be accomplished without problems and will stand up for a long time to the powerful impacts resulting from the bulk material excavation and the conveyance of the excavated bulk material. Because the guide rollers deflect the chain in each transition portion, it is possible to guide the chain in these portions, which are subjected to a high pressure by the forward thrust of the driven chain, with very little friction and wear. In addition, by deflecting the excavating chain into a plane extending substantially parallel to the track bed plane, the excavating and conveying capacity of the excavating scoops on the chain links will be enhanced since these scoops with their forwardly projecting excavating fingers will be guided substantially perpendicularly to the plane of the track bed so that the excavating fingers extend substantially parallel thereto. Therefore, the entire height of the scoops is identical with the actual excavating depth. This will additionally provide simultaneous planing of the track bed, the level of the smoothed track bed surface conforming to the desired grade.

Figure 2:
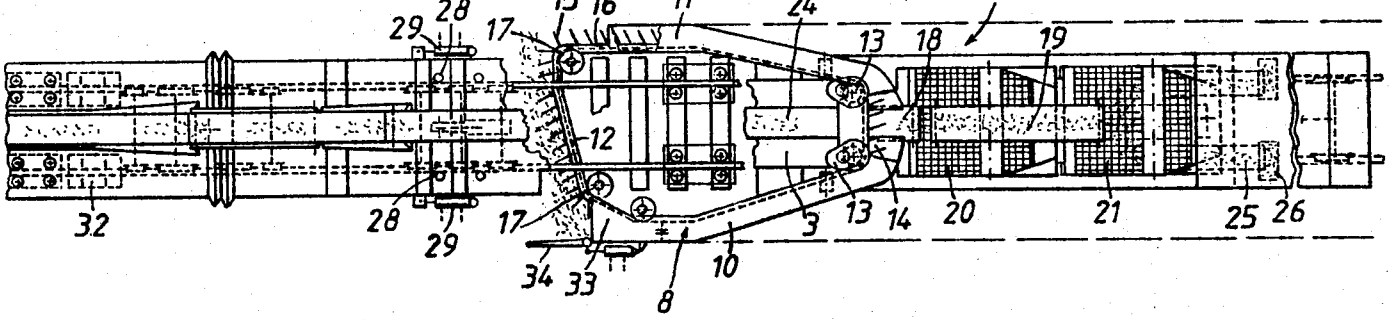
Figure 3:
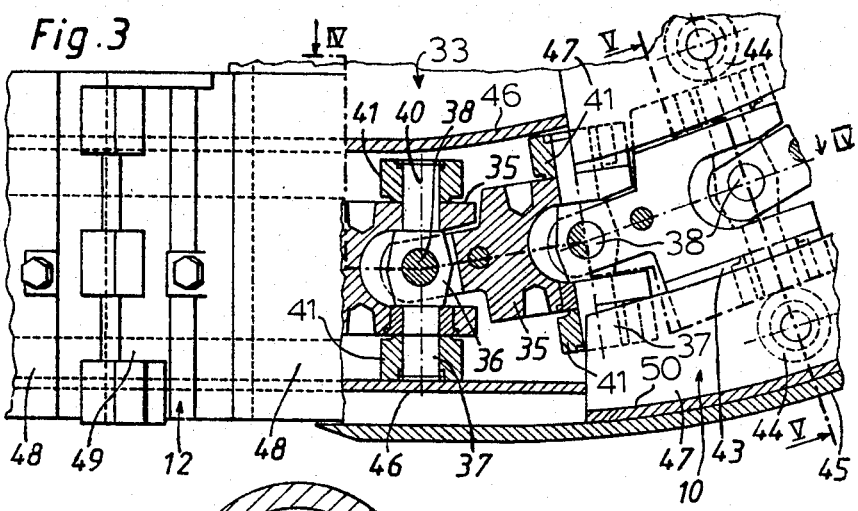
Figure 4:
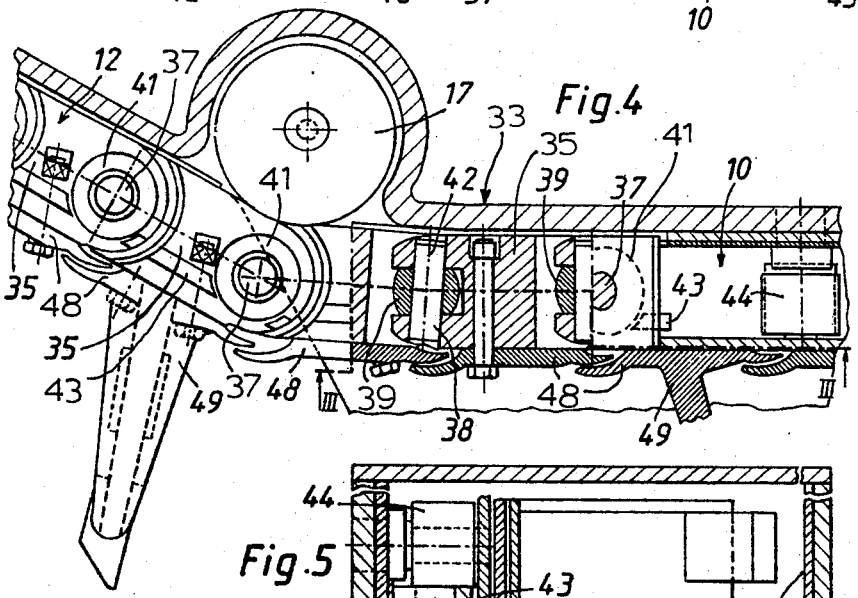
Figure 5:
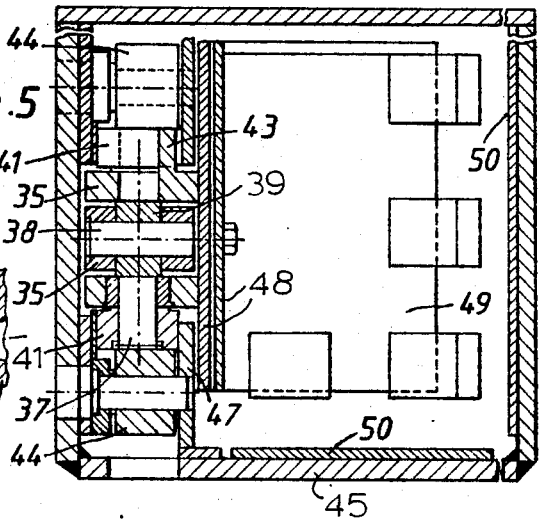
Figure 6:
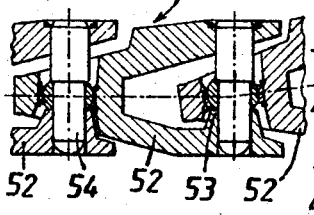
Figure 7:
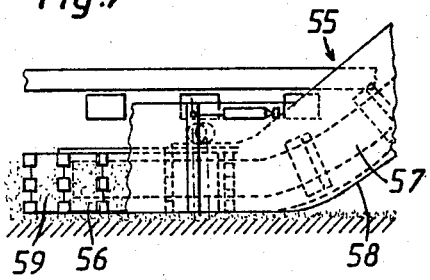
Figure 8:
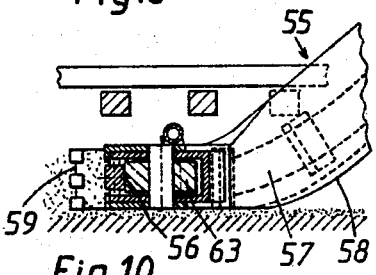
Figure 9:
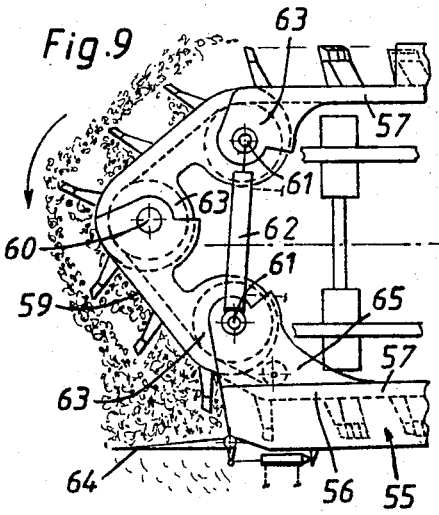
Figure 10:
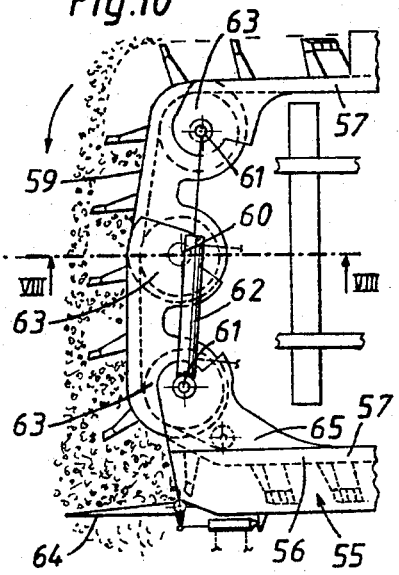
Figure 11:
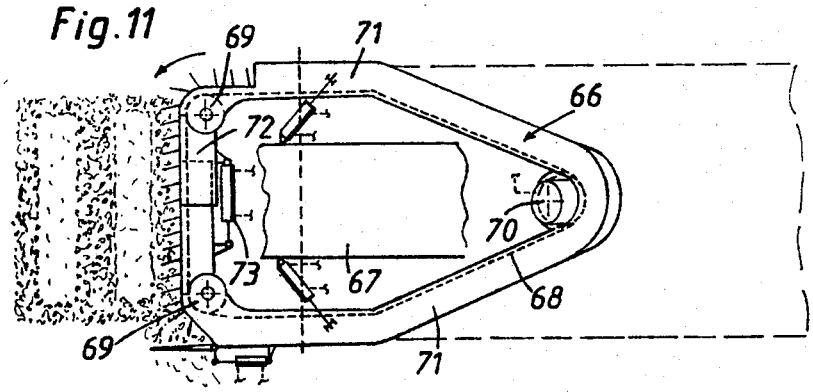

The above and other objects, advantages and features of the present invention will become more apparent from the following detailed description of certain now preferred embodiments thereof, taken in conjunction with the accompanying, partially schematic drawing wherein FIG. 1 is a side elevational view of a ballast cleaning machine incorporating the arrangement of this invention, FIG. 2 is a top view of FIG. 1, FIG. 3 is a fragmentary side view, partly in section, of the arrangement in the range of a transition portion, showing one embodiment of a joint connecting adjacent chain links, FIGS. 4 and 5 are respective sections along lines IV—IV and V—V of FIG. 3, FIG. 6 is a fragmentary section of the chain, showing another embodiment of the chain link joints, FIG. 7 is a fragmentary side view of another embodiment of the arrangement in the range of a transition portion, in a first operating position, FIG. 8 is a like view, partly in section, of the embodiment of FIG. 7 in a second operating position, FIG. 9 is a top view of FIG. 7, FIG. 10 is a top view of FIG. 8, and FIG. 11 is a top view showing a further embodiment of the bulk material excavating and conveying arrangement.

Referring now to the drawings and first to FIGS. 1 and 2, there is shown a track working machine constituted by ballast cleaning machine 1 which has frame 3 supported on undercarriages running on track 2 consisting of rails fastened to ties resting on ballast forming a track bed. The illustrated frame is comprised of two pivoted parts which are connected by power drive 4 positioned above the connecting pivot to enable the two frame parts to be pivoted. In the illustrated embodiments, drive 4 and all other power drives are hydraulic drives. The operating direction of machine 1 has been indicated by arrow 5. The machine has a power plant 6 supplying energy for the operating drives of the machine and a control 7 for controlling the drives.

Arrangement 8 for excavating bulk material, i.e. the ballast and any waste material that may be lodged therein, from the track bed and for conveying the excavated bulk material is pivotally mounted on frame 3. The arrangement comprises endless excavating and conveying chain 16 and a guide including two longitudinal guide sections 10, 11 and transverse guide section 12 wherein the chain is guided in an endless path. Power drives 9 link the longitudinal guide sections to the frame so that chain 16 is vertically adjustably mounted on frame 3. The two longitudinal guide sections have an upper end and a lower end, the upper ends being adjacent each other, and excavated bulk material discharge station 14 is arranged at the adjacent upper ends of longitudinal guide sections 10, 11. Transverse guide section 12 connects the lower longitudinal guide section ends opposite to discharge station 14 and, in its operating position, extends below track 2. As very clearly shown in FIG. 1, for example, the longitudinal guide sections have major portions obliquely rising from the track bed and transition portions at the lower ends for connection to the transverse guide section, and these transition arcuately to deflect the chain from the major oblique portions of the longitudinal guide sections into a direction extending portions extend substantially parallel to the plane of the track bed. Chain drive means 13, 13 are arranged at the adjacent upper ends of the longitudinal guide sections, with discharge station 14 being positioned between the two chain drives. Excavating and conveying chain 16 is equipped with laterally projecting excavating scoops 15 and may be driven in its endless path by drives 13, 13 for excavating the bulk material and conveying the excavated bulk material to discharge station 14, the chain being trained about chain guide rollers 17, 17 in each transition portion for deflecting the chain from a respective longitudinal guide section 10, 11 to transverse guide section 12. The guide rollers have an axis extending substantially perpendicularly to the track bed plane.

Short conveyor band 18 runs below discharge station 14 to receive the discharged excavated bulk material and has a discharge end from which further conveyor band 19 receives this material. Two screening installations 20, 21 are mounted on machine frame 3 and may be vibrated by vibrating drives 22, 23. The vibratory screening installations are mounted below conveyor bands 18, 19 to receive the excavated bulk material therefrom for separating the same into a cleaned ballast component and a waste component. Waste component conveyor band 24 runs centrally under the screening installations and moves the waste component to a series of successive conveyors mounted forwardly of conveyor band 24 in the operating direction of the machine for removing the waste from the operating site. Short conveyor bands 25, 25 are mounted under screening installation 21 in the range of each track rail for moving the cleaned ballast component to ballast distributing chutes 26, 26. Laterally pivotable conveyor band 27 is mounted under screening installation 20 for distributing the cleaned ballast component over the width of the track bed. Ballast planing device 27' is linked to machine frame 3 adjacent the discharge end of cleaned ballast component distributing conveyor band 27 and may be vertically adjusted for smoothing the distributed ballast at a desired grade, as shown in FIG. 1. During operation, track 2 may be lifted in the range of excavating and conveying arrangement 8 at three points to obtain a favorable flexing curve of the track rails. At one of these lifting points, machine frame 3 is supported on an undercarriage constituted by a three-axle swivel truck which carries laterally pivotable lifting rollers 28 operative to subtend and engage the rail heads for lifting. When, as shown in FIG. 1, power drive 4 is extended to spread the two frame parts apart above their connecting pivot 31, which extends horizontally in a direction transverse to the machine frame elongation, and thereby to pivot them, the engaged lifting rollers will cause the track to be lifted at this point. Two additional track lifting devices are shown at 28' and 28''. To enable the elongated two-part machine frame to move without danger of derailment in track curves, power drives 29 connect the two frame parts for adjusting the lateral positions of these parts, if and when needed. As shown in the drawing, auxiliary undercarriages 30, 30 are arranged on each side of the front undercarriage supporting machine frame 3 on track 2 and these auxiliary undercarriages may be subjected to vertical pressure to adjust their vertical position so as to relieve the axles of the front undercarriage from excessive loads when the two machine parts are strongly spread apart by drive 4.

Vertically adjustable tamping unit 32 with vibratory and reciprocatory ballast tamping tools and track lifting unit 32' are arranged immediately in front of forward auxiliary undercarriage 30, and the two units are mounted on a frame which may be shifted longitudinally with respect to frame 3.

The major portion of guide sections 10, 11 extend obliquely with respect to the track bed plane, longitudinal guide section 10 receiving an ascending portion of chain 16 driven by drive means 13, 13. As shown in FIG. 2, longitudinal guide section 10 comprises short connecting piece 33 in the transition portion extending obliquely towards transverse guide section 12. With this arrangement, the chain is deflected twice as it smoothly moves from the transverse to the longitudinal guide section without being subjected to an excessively large deflection angle. This avoids the centrifugal projection of the excavated ballast out of the excavating scoops, which would result from a sharp deflection of the excavating chain, to a large extent. FIGS. 3 to 5 illustrate one embodiment of excavating chain 16 comprised of a succession of like chain links 35 in the direction of elongation of the chain. Universal joints 36 connect adjacent chain links 35 against relative movement in this direction, the joints having pivoting axles 37, 38 for the adjacent chain links extending perpendicularly with respect to each other to permit pivoting of the chain links in intersecting planes. The pivoting axles are constituted by pins or bolts so arranged that axes 42 of bolts 38 extend parallel to the track bed plane along the transverse guide section while axes 40 of bolts 37 extend along the transverse guide section parallel to the track bed plane and perpendicularly to the direction of elongation of the chain. Intermediate bearing 39 is arranged between the two bolts of the joint. Pivot pins 37 have two ends projecting from chain links 35 and guide elements consisting of bolt nuts 41 guide the chain links longitudinally, particularly along the transition portions. The bolt nuts are mounted on the pivot pin ends. This chain arrangement has a very simple structure and enables the connecting chain link joints to be constructed in manifold manners. Where bolt nuts at the projecting ends of the pivot bolts serve as guide elements for the chain, the excavating chain may be subjected to very high loads without substantial wear and has considerable freedom of movement. The projecting bolt heads assure, at the same time, a very precise vertical and lateral guide for the chain while reducing friction to a minimum.

The bolt nuts are engaged by gears of drives 13 to transmit the driving force from the drives to the chain. Chain links 35 are pivotal about axes 40 and 42 in perpendicular, intersecting planes. FIGS. 3 and 4 show the transition from transverse chain guide section 12 to the transition portion of longitudinal chain guide section 10 in which the chain links are pivoted about horizontal axes 42 when the chain is driven up guide section 10. Guide rollers 17 are arranged in each transition zone for deflecting chain 16 from between a respective longitudinal guide section 10, 11 and transverse guide section 12, the axes of guide rollers 17 extending substantially perpendicularly to the track bed plane. As the chain moves between the guide sections, the chain links will pivot about axes 40 and 42. Vertically projecting guide ledges 43 are arranged between guide elements 41 for horizontally guiding chain 16 horizontally along guide rollers 44. Lower and upper guide rollers 44 are arranged in arcuate transition portion 45. Guide ledges 43 assure a continuous and precise horizontal chain guidance even if the chain links are relatively long and there is a considerable distance between guide elements. By providing guide and support rollers for the chain in the longitudinal guide sections, which are rotatable about transition portions of the horizontal axes extending transversely to the direction of elongation of the longitudinal guide sections, a considerable saving in driving energy may be obtained by reducing the gliding friction to which the chain is subjected while, at the same time, also minimizing wear so that the excavating chain may be subjected to a greater load. By providing guide rollers engaging an upper side of the chain deflected in transition portion 45, the guide rollers being rotatable about axes extending tranversely to the direction of elongation of longitudinal guide section 10, the chain will be deflected precisely and uniformly while being subjected to a minimal friction, thus enhancing the operating life of the excavating chain. In transverse guide section 12, the chain frictionally glides along guide 46 and vertical guide ledges 47 assure the lateral guidance of chain 16.

Protective plate 48 is detachably affixed to an outside of each chain link 35 facing the bulk material in the track bed. As best shown in FIG. 4, the protective plates on adjacent chain links have overlapping, arcuately shaped end portions slidably connecting the protective plates to each other. This arrangement provides an effective and long-lasting protection for the chain links against wear by the sharp edges of the ballast rocks and penetration by the dust resulting from the excavation, thus increasing the operating life of the excavating chain. At the same time, this effective chain link protection does not interfere with the full freedom of movement of the chain links because of the arcuate sliding connection of the links in the range of their connecting joints. Bulk material excavating scoops 49 are attached to each third protective plate 48. As shown in FIG. 5, transverse guide section 12 is constituted by a rectangular casing whose inside is lined by plates 50 of wear-resistant material.

In the embodiment of excavating chain 51 shown in FIG. 6, ball-and-socket joints 53 connect adjacent chain links 52 against relative movement in the direction of elongation of the chain. The chain links are pivotal about the axis of pivot pin or bolt 54 and a bearing ball in different, intersecting planes. Such joints assure a great freedom of movement of the chain link at a minimum structural cost and will assure a problem-free deflection of the chain links into different planes.

FIGS. 7 to 11 show bulk material excavating and conveying arrangement 55 with chain 56 driven in an endless path in a guide comprising transverse guide section 59 and longitudinal guide sections 57, 57 which have transition portions 58 at lower ends thereof for connection to the transverse guide section, the transition portions being arcuately bent to extend substantially parallel to the plane of the track bed. In this embodiment of the invention, the transverse chain guide section is comprised of two parts interconnected by center pivot 60 while the opposite ends of the transverse guide section parts are connected to the lower ends of the longitudinal guide sections by pivots 61. Pivots 61 are interconnected by power drive 62 which is shown in retracted position in FIG. 9 while it is extended in FIG. 10. In this manner, the operating width of the excavating arrangement may be readily adjusted to prevailing track bed dimensions. Guide rollers 63 are arranged at pivots 61 for deflection of the excavating chain in the manner described hereinabove in connection with guide rollers 17. Laterally pivotable ballast plow or baffle 64 is mounted on ascending longitudinal guide section 57 to cause the excavated bulk material to be properly conveyed at the transition zone. Ascending guide section 57 comprises short connecting piece 65 in the transition portion extending obliquely towards the transverse guide section.

FIG. 11 diagrammatically illustrates bulk material excavating and conveying arrangement 66 vertically adjustably mounted on frame 67 of a track renewal train for planing a ballast bed from which the track has been removed and conveying a portion of the ballast away. As shown, excavating and conveying chain 68 is driven by drive 70, the chain being trained about guide rollers 69, 69 for deflection between transverse guide section 72 and longitudinal guide sections 71, 71. The outer ends of the transverse guide section are pivoted to the lower ends of the longitudinal guide sections and the transverse guide section is comprised of two telescoped parts which may be retracted or extended by power drive 73 for the stepless adjustment of the width of the transverse guide section and the corresponding operating width of the excavating and conveying arrangement.

The operation of the hereinabove-described apparatus will be obvious from the description of the illustrated embodiments and will be more fully explained hereinafter in connection with the ballast cleaning machine shown in FIGS. 1 and 2.

After the lifting rollers of the track lifting devices have been pivoted into engagement with the rail heads, power drive 4 is actuated to spread the two parts of machine frame 3 apart and thus to initiate raising of track 2 with the raising of the machine frame parts at pivot 31. At the same time, auxiliary undercarriages 30 are lowered and pressure is applied thereto to relieve pressure on the front undercarriage which supports the machine frame for mobility on track 2 in the operating direction indicated by arrow 5. An opening has previously been prepared to enable transverse guide section 12 of bulk material excavating and conveying arrangement 8 to be introduced below track 2 in a conventional manner. Machine 1 is now placed in operation by actuating forward drive 6, drives 13 for chain 16 and vibrators 22 and 23 for ballast screening arrangements 20 and 21. The excavating and conveying chain is continuously driven counter-clockwise and is deflected between the oblique plane defined by the major portions of longitudinal guide sections 10, 11 and a plane extending parallel to the track bed plane, as defined by transverse guide section 12. A smooth and substantially friction-free transition between these planes is assured by the pivotal joints between the chain links as well as the guide elements described hereinabove. The bulk material excavated by scoops 49 along the transverse guide section is upwardly conveyed along longitudinal guide section 10 to discharge station 14, a suitable pivotal positioning of baffle 34 preventing a lateral displacement of the excavated bulk material from its conveying path. The bulk material is discharged from station 14 to short conveyor band 18 which throws some of the material onto front screening installation 20 while another part of the material is thrown onto conveyor band 19 which, in turn, throws it onto rear screening installation 21. The cleaned ballast component from installation 20 is thrown by pivotable ballast redistributing conveyor 27 onto the exposed sub-grade while the cleaned ballast component from installation 21 is moved by conveyors 25 into chutes 26 for filling the cribs between the track ties. Rear conveyor band 19 may be longitudinally displaced so as to change the amount of the excavated bulk material received by rear screening installation 21. Since track 2 must be raised by a substantial lifting stroke, particularly when the depth of the ballast bed is relatively low, to enable transverse guide section 12 to be disposed below the track, the ballast is provisionally tamped under the ties by tamping unit 32 while the track is lifted. In this manner, the flexing curvature of the rail of track 2 remains within permissible limits while the track lifting devices are in operation. The driven chain constructed according to this invention assures an accurate working of the track bed and the resulting surface will be substantially in conformity with the desired track bed surface for receiving the track ties in the desired position.

What is claimed is:

1. An arrangement for excavating bulk material from a track bed and for conveying the excavated bulk material, which comprises (a) an endless excavating and conveying chain vertically adjustably mounted on a frame of a track working machine, the chain being comprised of (1) a succession of chain links in the direction of elongation of the chain and (2) joints connecting adjacent ones of the chain links against relative movement in said direction, the joints having pivoting axles for the adjacent links, the axles extending perpendicularly with respect to each other to permit pivoting of the chain links, (b) a guide wherein the chain is guided in an endless path, the guide including (1) two longitudinal guide sections, each longitudinal guide section having an upper and a lower end, the upper ends being adjacent each other, (2) an excavated bulk material discharge station at the adjacent upper ends of the longitudinal guide sections, and (3) a transverse guide section connecting the lower longitudinal guide section ends opposite to the discharge station, the longitudinal guide sections each having a major portion obliquely rising from the track bed and an arcuate transition portion at the lower end for connection to the transverse guide section, the transition portions deflecting the chain from the major oblique portions of the longitudinal guide sections into a direction extending substantially parallel to the plane of the track bed, and the pivoting axles of the joints permitting the chain links to pivot between the planes of the major and transition portions of the longitudinal guide sections and the transverse guide section, (c) chain drive means at the adjacent upper longitudinal guide section ends, (d) guide means for the chain links for guiding the chain longitudinally along the transition portions as the chain links pivot, and (e) a lower and an upper chain guide roller in each one of the transition portions, the guide rollers being rotatable about horizontal axes extending transversely to the direction of elongation of the longitudinal guide sections and guidingly supporting the chain for deflecting the chain between a respective one of the longitudinal guide sections and the transverse guide section.

2. The arrangement of claim 1, wherein the pivoting axles are arranged so that one of the axles extends perpendicularly to the track bed plane along the transverse guide section while the other axle extends parallel to the track bed plane and perpendicularly to the direction of elongation of the chain along the transverse guide section.

3. The arrangement of claim 2, wherein the joints are universal joints including pivot pins having two ends projecting from the chain links, and said guide means comprises guide nuts mounted on the pivot pin ends.

4. The arrangement of claim 3, wherein the guide means further comprises vertically projecting guide ledges arranged to contact the guide elements for horizontally guiding the chain.

5. The arrangement of claim 1, wherein the joints are ball-and-socket joints.

6. The arrangement of claim 1, further comprising a protective plate detachably affixed to an outside of each one of the chain links facing the bulk material in the track bed, the protective plates on the adjacent chain links having overlapping, curved ends sliding over each other.

7. The arrangement of claim 6, further comprising bulk material excavating scoops on the protective plates.

8. The arrangement of claim 1, wherein the major obliquely rising portion of one of the longitudinal guide sections receives an ascending portion of the chain driven by the drive means, and the one longitudinal guide section comprises a short connecting piece in the transistion portion extending obliquely towards the transverse guide section.

9. The arrangement of claim 1, wherein the obliquely rising portion of one of the longitudinal guide sections receives an ascending portion of the chain driven by the drive means, and further comprising guide rollers engaging an upper side of the chain and being rotatable about axes extending transversely to the direction of elongation of the longitudinal guide section.

* * * * *